US005118474A

United States Patent [19]

Rogalsky

[11] Patent Number: 5,118,474

[45] Date of Patent: Jun. 2, 1992

[54] LABORATORY PIPET

[76] Inventor: Vitaly Rogalsky, 186 Pinehurst Ave. #3D, New York, N.Y. 10033

[21] Appl. No.: 245,525

[22] Filed: Sep. 19, 1988

[51] Int. Cl.[5] ..... B01L 3/02

[52] U.S. Cl. ..... 422/100; 73/864.11; 73/864.14; 73/864.16

[58] Field of Search ..... 422/100; 73/864.11, 73/864.14, 864.16

[56] References Cited

U.S. PATENT DOCUMENTS

| | | | |
|---|---|---|---|
| 2,595,493 | 5/1952 | Slaby et al. | 422/100 |
| 4,296,071 | 10/1981 | Weiss et al. | 422/100 |
| 4,444,062 | 4/1984 | Bennett et al. | 73/864.11 |
| 4,511,534 | 4/1955 | Bennett et al. | 73/864.11 |

FOREIGN PATENT DOCUMENTS

| | | | |
|---|---|---|---|
| 0215536 | 3/1987 | European Pat. Off. | 422/100 |
| 2493515 | 5/1982 | France | 422/100 |
| 2609692 | 7/1988 | France | 422/100 |

*Primary Examiner*—David L. Lacey
*Assistant Examiner*—William H. Beisner

[57] ABSTRACT

A laboratory pipet has a pipe member with a first end through which a liquid is taken into and discharged from the pipe member, and a second opposite end provided with an elastic flat diaphragm formed so that by depressing and releasing the diaphragm with the first end immersed into a liquid the liquid can be drawn into the pipe member, and by subsequent depressing the diaphragm the liquid can be discharged from the pipe member.

5 Claims, 2 Drawing Sheets

LABORATORY PIPET

BACKGROUND OF THE INVENTION

The present invention relates to laboratory pipets for taking and discharging liquids.

Laboratory pipets are known in several modifications, and widely used. The laboratory pipet in accordance with one construction has a rubber tip which can be compressed by fingers and released for respective operations of taking a liquid into a pipe member attached to the tip, and discharging the liquid. Such pipets do not provide a desired accuracy of dosaging the liquids. The laboratory pipet in accordance with another construction has a piston which is movable in a cylinder for respective operations of taking the liquid in and then discharging the liquid from the pipe member. This construction is rather complicated and expensive.

SUMMARY OF THE INVENTION

Accordingly, it is an object of the present invention to provide a laboratory pipet which avoids the disadvantages of the prior art.

More particularly, it is an object of the present invention to provide a laboratory pipet which provides highly accurate doses of a discharged liquid and at the same time has a simple constructions.

In keeping with these objects and with others which will become apparent hereinafter, one feature of the present invention resides, briefly stated, in a pipet which has a pipe member with a taking and discharging end and an opposite end provided with a flat elastic diaphragm, such that by depressing and releasing the diaphragm with the first mentioned end in a liquid, the liquid is taken into the pipe member, and by subsequent depressing the diaphragm the liquid is discharged from the pipe member.

Such a pipet is efficient, provides highly accurate doses of liqiud, and has a simple construction.

The novel features of the present invention are set forth in particular in the appended claims. The invention itself, however, will be best understood from the following description of a preferred embodiment which is accompanied by the following drawings.

DESCRIPTION OF PREFERRED EMBODIMENTS

Figure 1:
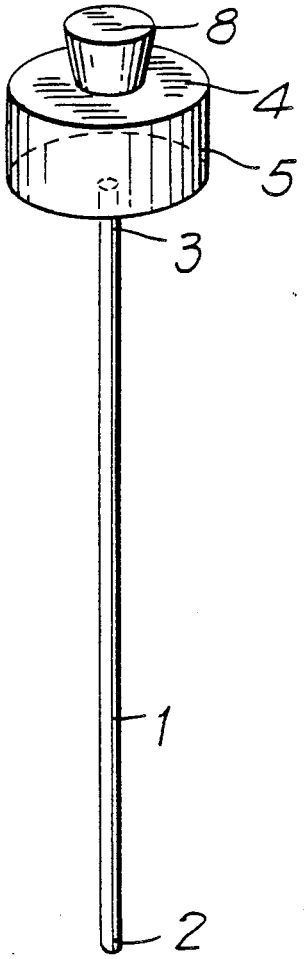
FIG. 1 is a perspective view of a laboratory pipet in accordance with one embodiment of the present invention.
Figure 2:
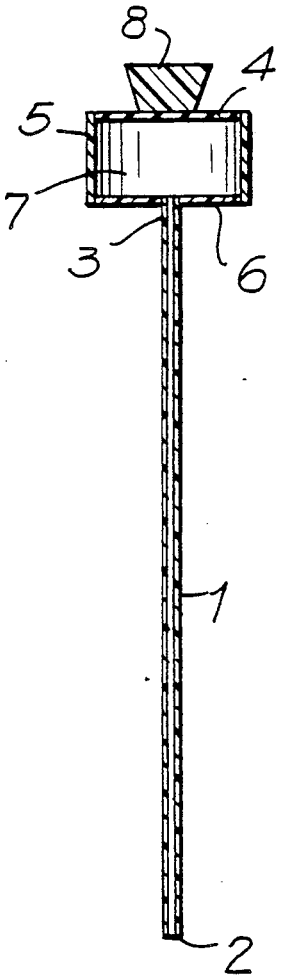
FIG. 2 is a side view of the inventive pipet of FIG. 1.
Figure 3:
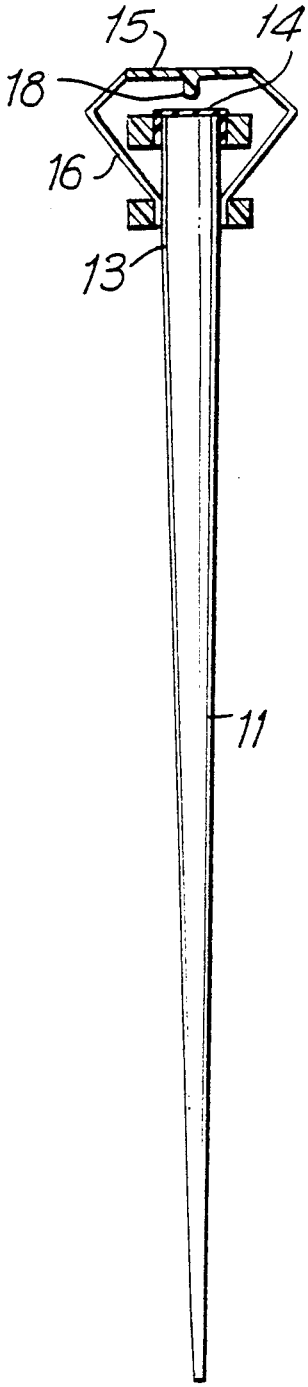
FIG. 3 is a side view of a laboratory pipet in accordance with another embodiment of the present invention.
Figure 4:
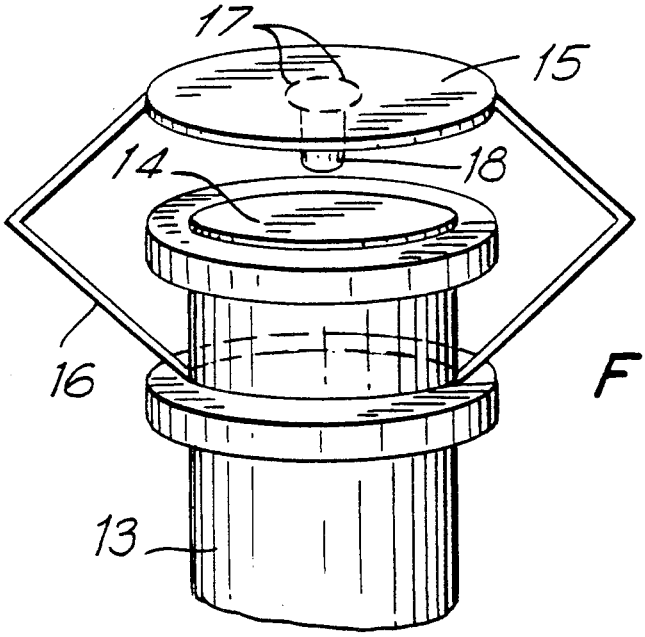
FIG. 4 is an enlarged view of a portion of the laboratory pipet of FIG. 3.

As can be seen from FIG. 1, a laboratory pipet in accordance with one embodiment of the present invention has a pipe member 1 which has a first end 2 for taking a liquid in the pipe member and discharging the liquid from the latter. The pipe member also has a second opposite end 3.

The pipet is further provided with an elastic flat diaphragm 4 composed for example from rubber, such as latex, etc. In the shown embodiment the diaphragm extends perpendicularly to the axis of the pipe member; however, it can have a different orientation as well. The diaphragm 4 is connected with the end 3 of the pipe member 1 by a peripheral closed wall 5 and a lower disc 6. The elements 3, 4, 5 and 6 together form a chamber.

The wall 5 is rigid so that the diphragm is tensioned on the upper edge of the wall and connected with the latter by known means, for example by welding. The wall 5 as well as the disc 6 can be composed of a rigid plastic. The end 3 of the pipe member 1 opens through the disc 6 into the chamber 7. The diaphragm 4 is provided with a projection 8 which is preferably arranged in its center.

By successive pressing and releasing the projection 8, which is preferably rigid and connected with the diaphragm by known means for example by gluing, the diphragm reduces and increases the volume of the chamber 7 so as to gradually suck a liquid into the chamber 7. By a subsequent depressing of the projection 8 into the diaphragm 4, a predetermined dose of liquid is discharged from the chamber 7 through the end 2 of the pipe member 1.

In accordance with another embodiment of the present invention, a diaphragm 14 is attached to and tensioned over an end 13 of a pipe member 11. A projection 18 is mounted on a support 15 which is formed as a substantially rigid disc. The support 15 is connected with the pipe member 11 by elastic connecting strips or bridges 16. The support 15 has a diameter which is greater than the diameter of the diaphragm 14. When the support 15 is pressed by a user toward the diaphragm 14 and then released, the support 15 moves back under the action of relaxed strips 16.

By successive pressing and releasing of the support 15 and thereby successive depressing the projection 18 into the diaphragm 14 and releasing the latter, a liquid is sucked into the pipe member 11. Then when a user presses the support toward the diaphragm and depresses the projection 18 into the diaphragm, a predetermined dose of liquid which is exactly equal to the volume of the projection 18 is expelled from the pipe member 11.

In accordance with a further feature of the present invention, a plurality of breaking perforations 17 are formed around the projection 18 in the support 15. Thereby when the support 15 has been displaced so that it abuts against the upper surface of the end 13 of the pipe member 11 and a user continues to apply pressure against the projection 18, the support breaks in the region of the perforations 17 and the projection 18 can be displaced further into the diaphragm. This insures a complete expulsion of the liquid from the pipet.

It is to be understood that by selecting the projection 18 of different sizes, doses of liquid of respective different sizes can be administered.

Figure 5:
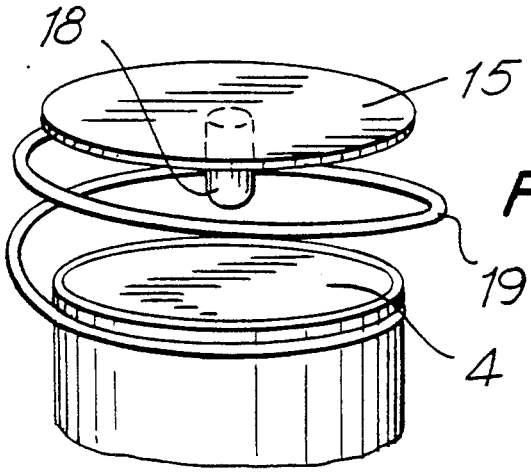
FIGS. 5 and 6 are views showing two further modifications.
Figure 6:
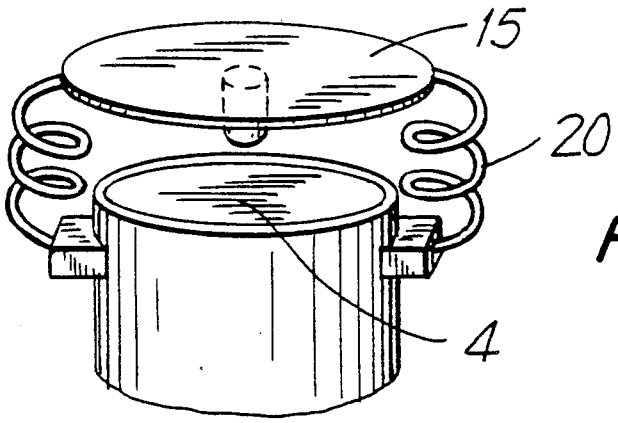

FIG. 5 shows that the support 15 can be connected with the pipe member 11 by a single spring 19. FIG. 5 shows that the support 15 can be connected with the pipe member 11 by two springs 20 at opposite sides.

The invention is not limited to the details shown since various modifications and structural changes are possible without departing in any way from the spirit of the invention.

What is desired and claimed to be protected by Letters Patent is set forth in the appended claims.

1. A laboratory pipet, comprising a pipe member having a first end for taking a liquid into and discharging a liquid from said pipe members, and a second end opposite from said first end; a flat elastic diaphragm arranged at said second end of said pipe member so that by depressing and releasing of said flat elastic diaphragm at said second end with said first end introduced in a liquid the liquid is drawn into said pipe member through said first end, while by subsequent depressing of said flat elastic diaphragm the liquid is discharged from said pipe member through said first end; a projection positioned and arranged with respect to said diaphragm and engageable by a user so as to depress said diaphragm and said projection, said projection being spaced from said diaphragm; means for guding a movement of said projection toward said diaphragm for depressing the latter, said guiding means including means for attaching said projection to said pipe member in a movable manner; a support which supports said projection and is fixedly connected therewith, said attaching means connecting said support with said pipe member, said support being constructed so as to be breakable substantially around said projection, so that upon movement of said support with said projection toward said diaphragm and depressing of said diaphragm by said projection with an abutment of said support against said first end of said pipe member, said support can be broken when a user presses further said projection into said diaphragm.

2. A laboratory pipet as defined in claim 1, wherein said attaching means is elastic so that when a user depresses said diaphragm by said projection and then releases said projection, said projection moves elastically away of said diaphragm.

3. A laboratory pipet as defined in claim 1, wherein said attaching means includes a spring-shaped member connected with said pipe member and connecting the latter with said projection.

4. A laboratory pipet as defined in claim 1, wherein said attaching means includes at least one spring which extends between and connects said pipe member with said support.

5. A laboratory pipet as defined in claim 1, wherein said attaching means includes two springs which are located at opposite sides of said support and said pipe member and connect said support with said pipe member.

* * * * *